US011388543B2

(12) United States Patent
Ingebritsen

(10) Patent No.: US 11,388,543 B2
(45) Date of Patent: Jul. 12, 2022

(54) SYSTEMS, DEVICES, AND METHODS FOR RECONFIGURING AND ROUTING A MULTICHANNEL AUDIO FILE

(71) Applicant: Ryan Ingebritsen, Chicago, IL (US)

(72) Inventor: Ryan Ingebritsen, Chicago, IL (US)

( * ) Notice: Subject to any disclaimer, the term of this patent is extended or adjusted under 35 U.S.C. 154(b) by 0 days.

(21) Appl. No.: 16/389,016

(22) Filed: Apr. 19, 2019

(65) Prior Publication Data

US 2019/0261127 A1 Aug. 22, 2019

Related U.S. Application Data

(62) Division of application No. 15/350,033, filed on Nov. 12, 2016, now Pat. No. 10,327,091.

(51) Int. Cl.

| | |
|---|---|
| ***H04S 7/00*** | (2006.01) |
| ***H04R 5/02*** | (2006.01) |
| ***H04R 5/04*** | (2006.01) |
| ***H04S 3/00*** | (2006.01) |

(52) U.S. Cl.

CPC ..... *H04S 7/308* (2013.01); *H04R 5/02* (2013.01); *H04R 5/04* (2013.01); *H04R 2420/07* (2013.01); *H04R 2430/01* (2013.01); *H04S 3/008* (2013.01); *H04S 2400/01* (2013.01); *H04S 2400/03* (2013.01)

(58) Field of Classification Search

CPC ..... H04S 7/308; H04S 3/008; H04S 2400/01; H04S 2400/03; H04R 5/02; H04R 5/04; H04R 2420/07; H04R 2430/01

See application file for complete search history.

(56) References Cited

U.S. PATENT DOCUMENTS

| | | | | |
|---|---|---|---|---|
| 8,434,006 | B2 * | 4/2013 | Profitt | H04R 5/04 715/722 |
| 9,426,598 | B2 * | 8/2016 | Walsh | H04S 7/301 |
| 9,554,211 | B2 * | 1/2017 | Boehlke | H04R 5/00 |
| 10,327,091 | B2 * | 6/2019 | Ingebritsen | H04S 7/308 |
| 10,674,299 | B2 * | 6/2020 | Chon | G10L 19/008 |
| 2010/0278346 | A1 * | 11/2010 | Hogue | H04S 7/308 381/18 |
| 2014/0139738 | A1 * | 5/2014 | Mehta | H04N 21/233 348/515 |

* cited by examiner

*Primary Examiner* — Andrew L Sniezek

(74) *Attorney, Agent, or Firm* — Incubate IP; Randy R. Micheletti

(57) ABSTRACT

Presented herein are systems, methods and devices for reconfiguring and routing a multichannel audio file to an external audio system. One method includes, in any logical combination and order: identifying, by an input configuration module of a dedicated software application running on a computing device, a plurality of input channels in the multichannel audio file; identifying, by an output configuration module of the dedicated software application, a desired output configuration having a plurality of output channels; assigning, by the output configuration module, each of the input channels to one or more of the output channels such that each of the input channels corresponds to one or more assigned output channels; and routing, by a routing module of the dedicated software application, each of the input channels to the corresponding one or more assigned output channels.

23 Claims, 5 Drawing Sheets

SYSTEMS, DEVICES, AND METHODS FOR RECONFIGURING AND ROUTING A MULTICHANNEL AUDIO FILE

CROSS REFERENCE TO RELATED APPLICATIONS

This is divisional application which claims priority to U.S. application Ser. No. 15/350,033 filed Nov. 12, 2016 under 35 USC 121, incorporated herein in its entirety.

TECHNICAL FIELD

The present disclosure relates generally to routing of multichannel audio files. Specifically, aspects of the present disclosure relate to reconfiguring the channels in a multichannel audio file and routing the reconfigured channels according to a preferred output configuration.

BACKGROUND

Traditional audio (commonly known as "screen channel") typically consists of a single audio track that is played with single-channel or dual-channel speaker arrangements with a single center channel and/or left and right channels originating only from the listener's forward arc. Multichannel audio (commonly known as "surround sound"), by contrast, can be typified as audio that contains two or more individual tracks played with multi-channel speaker arrangements with additional audio channels from speakers that surround the listener (surround channels) in an attempt to improve the listener's experience. Multichannel audio generally gives a sense of directionality to the audio. Surround sound systems have become commonplace in the home so consumers can listen to multichannel audio mixes. Many home audio systems are limited to setups involving between three and five speakers. As a result, consumers are often limited to listening to simple multichannel audio mixes specifically designed for their limited setups.

In the music industry, there is a large amount of multichannel audio being produced that is designed for audio setups that are much more complex. Multichannel audio designed to be played on systems involving eight or ten speakers, as well as audio designed to be played on 3D systems (i.e., systems having high and low speakers) is commonly produced, yet not commonly played in an average household. Audio systems necessary to listen to such audio are generally designed by trained professionals and can often cost thousands of dollars. As such, many of these complex multichannel mixes are relegated to special events and large venues. Accordingly, there is not very wide dissemination of this music. Both producers of complex multichannel audio mixes and home consumers face challenges in getting such mixes to consumers and allowing consumers to easily listen to the mixes.

Audio systems have been developed to try to solve some of the difficulties associated with complex multichannel audio mixes. Many of these systems focus generally on providing wireless transmission of audio signals to speakers or headphones. However, these systems do not address the challenges that producers and consumers of complex multichannel audio mixes face, namely that current setups needed to play these complex mixes are costly and often unobtainable. Therefore, a new system that solves the current problems in the field is needed.

SUMMARY

Aspects of the present disclosure are directed to a method of reconfiguring and routing a multichannel audio file. For some implementations, the method is executed with a dedicated software application, which is runs on a computing device and comprises a plurality of processor-executable program modules. These program modules are configured to: identify a plurality of input channels in the multichannel audio file; identify a desired output configuration having a plurality of output channels; assign each of the input channels to one or more of the output channels such that each input channel corresponds to one or more assigned output channels; and route each of the input channels to the corresponding assigned output channel or channels.

Other aspects of the present disclosure are directed to a system for reconfiguring and routing a multichannel audio file. The system includes an audio interface device with a housing, one or more program channel ports coupled to the housing, one or more subwoofer ports coupled to the housing, and a wireless transmitter interface coupled to the housing. The system further comprises a dedicated software application that is running on a computing device. The dedicated software application contains a plurality of processor-executable program modules. These program modules are configured to: identify a plurality of input channels in the multichannel audio file; identify a desired output configuration having a plurality of output channels; assign each of the input channels to one or more of the output channels such that each input channel corresponds to one or more assigned output channels; and route each of the input channels to the corresponding one or more assigned output channels. In some optional configurations, the system further comprises a plurality of external speaker devices configured to receive audio signals corresponding to the assigned output channels.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
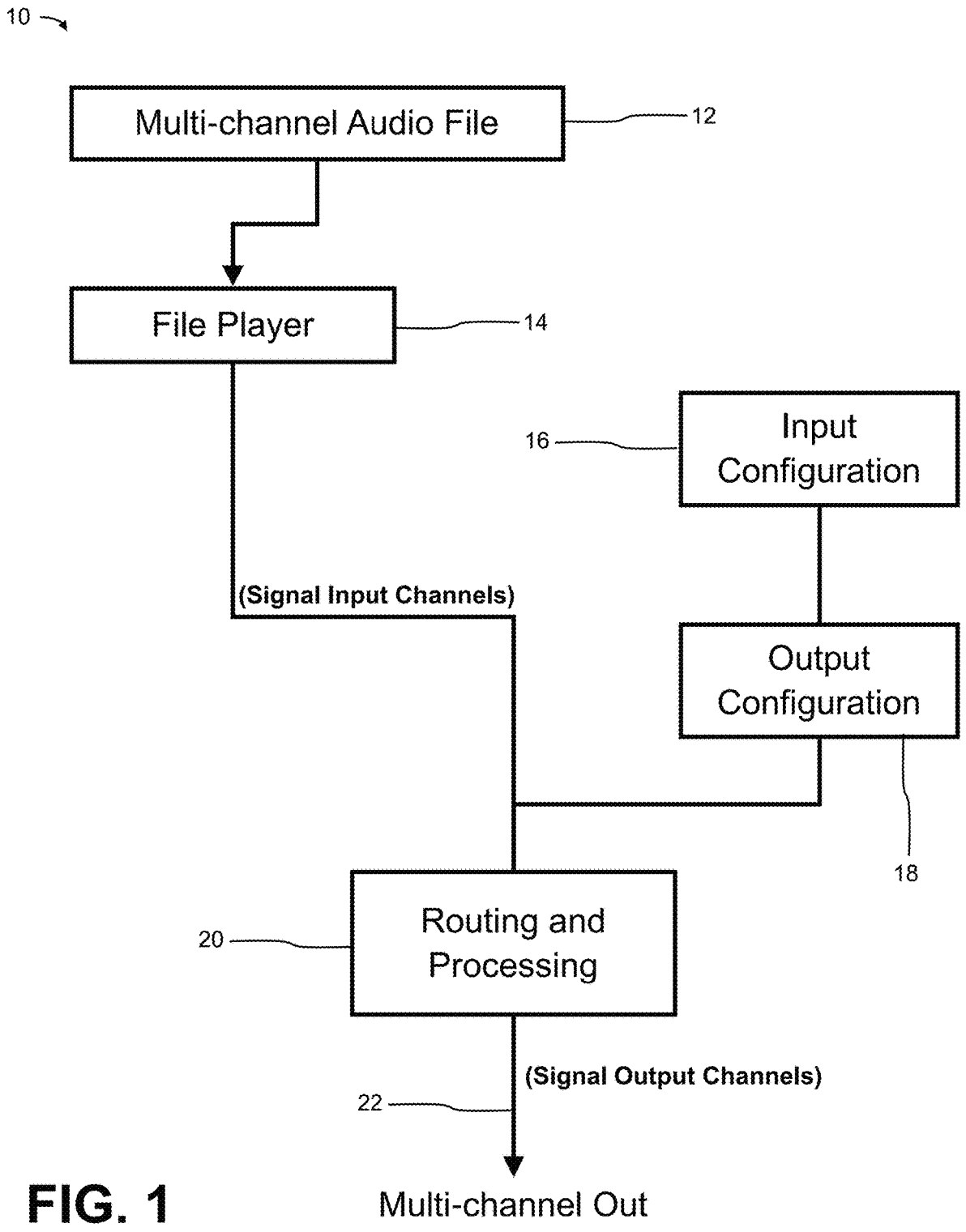
FIG. 1 is a flowchart illustrating a representative method for reconfiguring and routing a multichannel audio file according to the principles herein.

The present disclosure is susceptible to various modifications and alternative forms, and some representative embodiments have been shown by way of example in the drawings and will be described in detail herein. It should be understood, however, that the inventive aspects of the disclosure are not limited to the particular forms disclosed.

Rather, the disclosure is to cover all modifications, equivalents, and alternatives falling within the spirit and scope of the invention as defined by the appended claims.

DETAILED DESCRIPTION

This disclosure is susceptible of embodiment in many different forms. There is shown in the drawings, and will herein be described in detail, representative embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation." Additionally, the singular terms "a," "an," and "the" include plural referents unless context clearly indicates otherwise.

Aspects of the present disclosure are directed to a system that is able to receive a multichannel audio file containing multiple input channels designed to be played on a specific surround sound configuration. The input channels include, for example, both program channels and subwoofer channels. Program channels are generally considered full-bandwidth channels. Thus, program channels are configured to carry low-, mid-, or high-frequency audio signals, or any combination of the three. Subwoofer channels, by contrast, are generally configured to carry only low-frequency audio signals. The system is able to play back audio corresponding to each of the input channels in a surround sound configuration that is different from the sound configuration on which the file was designed to be played. Each input channel is assigned and routed to one or more output channels in a way that generally reproduces the desired sound.

For example, an audio file containing ten different audio channels may be considered to be octophonic. This configuration includes eight full-bandwidth channels to be played on eight individual full-bandwidth speakers. The configuration generally also includes two additional low-frequency channels to be played on two subwoofers. A consumer may not have all of the necessary equipment to play back this audio file as it was recorded. However, the consumer may have a commonly found 5.1 ("five point") surround sound setup, which includes five full-bandwidth "program" channels and one low-frequency effects "subwoofer" channel. The program channels are generally designated as a center channel, front left and front right channels, and surround left and surround right channels. Systems, methods and devices described herein are designed to route the ten channels from the audio file (eight full band-width channels and two low frequency channels) to the five full-bandwidth speakers and one subwoofer that the consumer possesses in such a manner that the octophonic sound is replicated. In this configuration, eight full-bandwidth input channels are assigned and routed to five full-bandwidth output channels, while two low-frequency input channels are assigned and routed to a single low-frequency output channel. Possible multichannel input and output configurations include, but are not limited to: two channel, four channel (quadrophonic), five channel (surround), eight channel (octophonic), eight channel (dual quadrophonic), eight channel (3D quadrophonic), ten channel (decaphonic), ten channel (dual surround), and ten channel (3D surround).

An exemplary system includes a computing device, an audio interface device, and one or more external speaker devices coupled to the audio interface device. The processing device generally contains a dedicated software application that includes a plurality of processor-executable program modules. Each of the modules are executable to carry out certain tasks as described herein. For some optional system architectures, the dedicated software application and/or audio interface device are provided to the end user while the computing device and speaker package are provided by the end user or one or more third party vendors.

The computing device identifies the input configuration of a multichannel audio file. The input configuration will have a certain number of input channels arranged in a certain manner. Two different input configurations may have the same number of input channels but different arrangements of those channels, such is the case with eight channel (octophonic) and eight channel (dual quadrophonic). A desired output configuration is then identified, the desired output configuration having a number or configuration of output channels that is different than the input configuration. Based on the selected output configuration, the computing device assigns each input channel to one or more output channels. Each input channel may be assigned to one or more output channels. For example, a single channel in an octophonic audio file may be assigned to multiple output channels in a 5.1 configuration (i.e. the center, front left, and surround left). Similarly, a single output channel in a 5.1 configuration may be assigned to multiple input channels from the audio file. Each input channel is then routed to its one or more assigned output channels. Each assigned output channel has a corresponding audio scaling level that determines the relative volume of that assigned output channel when played on a speaker device. The assigned output channels are then transmitted to a plurality of external speaker devices to be played back. Generally, a single external speaker device corresponding to a single output channel (e.g. the center speaker corresponding to the center channel in a 5.1 configuration) will play back audio corresponding to multiple input channels, rather than just a single input channel.

All of the assigned output channels in the above example are transmitted to an audio interface device as audio signals. The audio interface device then distributes each audio signal to an external speaker device. The connection between the audio interface device and the external speaker devices may be a wired connection or a wireless connection, or a combination of both depending on system architecture. Where the external speaker devices are connected to the audio interface device through a wireless connection, an address selector is used to designate which external speaker device corresponds to which output channel.

The computing device is also able to control playback of the multichannel audio file. A system according to the principles herein will generally include standard media player functionality, such as play, pause, fast-forward, reverse, next track, previous track, shuffle. Other media player functions are contemplated as well.

With reference now to the flow chart of FIG. 1, there is shown a novel method or work flow process, designated generally as 10, for reconfiguring and routing a multichannel audio file. FIG. 1 can be indicative of a method for identifying individual input channels in a multichannel audio file, selecting a desired output configuration, assigning each input channel to one or more output channels, and routing each input channel to its assigned output channel(s). FIG. 1 can be representative of an algorithm that corresponds to instructions that are stored, for example, in a main memory and executed, for example, by a controller/central processing unit, for example, of a personal computing device to perform any or all of the above or below described functions associated with the disclosed concepts. The method 10 is described with reference to various aspects and features as described elsewhere herein; such reference is being provided purely by way of explanation and clarification.

The method 10 begins at block 12 where a multichannel audio file exists on, or is received by, the computing device. The multichannel audio file contains, for example, header information indicating the number and configuration of input channels in the file. The header information may also indicate if the file has multiple input configurations. This refers to a situation where the multichannel audio file may be played natively (i.e. with no reconfiguring and routing of the input channels) on multiple multichannel configurations. The header information can also indicate generally with which output configurations the audio file may be played.

The method 10 proceeds to block 14, where a multichannel audio file is selected for reconfiguration and routing according to the principles herein and loaded into a memory area of the computing device so that the program modules may access the file. This selection may be made by the user through a corresponding electronic input device of the computing device, may be made automatically by an executable module in the dedicated software application, or may be the product of a collaborative determination by the user and software application. The multichannel audio files available for selection may be presented to the user in a drop-down menu or other graphical control element in a graphical user interface (GUI) of the computing device.

Next, as shown in block 16, an input configuration module reads the header information of the audio file and identifies a plurality of input channels and their configuration. These input channels correspond to the number of channels on which the file was originally designed to be played. If the header information indicates that the audio file may be played on multiple different configurations, the input configuration module may identify a different number of input channels based on the input configuration selected by/through the input configuration module. Alternatively, the different input configurations may contain the same number of input channels but utilize those input channels differently. For example, the header information in an audio file may indicate that the file is capable of being played in both an octophonic configuration and a dual quadrophonic configuration. Both configurations contain eight input channels, but each configuration plays the channels differently to achieve a desired sound. In that case, the input configuration module selects whether the audio file is to be treated as having an octophonic input configuration or a dual quadrophonic input configuration and identifies the appropriate input channels based on this designation. Alternatively, the header information may indicate that the audio file contains eight channels in an octophonic configuration and ten channels in a decaphonic configuration. Again, the input configuration module selects which input configuration to utilize and identifies the number of input channels to be assigned and routed according to the principles herein.

In block 18, an output configuration module identifies a desired output configuration from a list of all possible output configurations contained, for example, in a library file. The output configuration module then assigns each input channel to one or more of the output channels. This results in each input channel corresponding to one or more assigned output channels. Generally, each input channel is assigned to multiple output channels, and each output channel has multiple input channels assigned to it. However, it is contemplated that, depending on the input and output configurations identified, an input channel may be assigned to a single output channel. Similarly, it is contemplated that an individual output channel may only have a single input channel assigned to it. The output configuration module also determines the appropriate audio scaling level of each assigned output channel. The audio scaling level determines the relative volume of an assigned output channel as compared to the remaining assigned output channels. The value of the audio scaling level is generally in a range from 0 to 1. The output configuration module then sends these assignments to the routing module, which utilizes them to route the input channels correctly. The output configuration module assigns each input channel such that when played on an external audio system, the assigned output channels replicate the sound of the input configuration.

The following paragraph describes an exemplary operation of the input configuration module and the output configuration module during block 16 and block 18, respectively. The input configuration module may identify eight program channels in the multichannel audio file corresponding to an octophonic input configuration. The output configuration module then identifies the desired output configuration as having four program channels. This configuration is commonly known as a quadrophonic configuration. The output configuration module then assigns each of the eight input channels to one or more of the four output channels. In this example, the assignments are as follows: (i) the first, second, third, and eighth input channels are assigned to the first output channel; (ii) the second, third, fourth, and fifth input channels are assigned to the second output channel; (iii) the first, sixth, seventh, and eighth input channels are assigned to the third output channel; and (iv) the fourth, fifth, sixth, and seventh input channels are assigned to the fourth output channel. As shown, each of the eight input channels in the octophonic configuration is assigned to two of the output channels in the quadrophonic configuration. Each assignment of an input channel to an output channel has a respective audio scaling level. For instance, the audio scaling level of an input channel assigned to a first output channel may be, for example, 0.52. The audio scaling level of that same input channel assigned to a second output channel may be, for example, 0.82.

The reconfiguring of an octophonic input configuration to a quadrophonic output configuration as described in the preceding paragraph is for illustrative purposes only. Other possible ways of assigning input channels in an octophonic configuration to output channels in a quadrophonic configuration are contemplated. For any input and output configuration, each input channel is not necessarily assigned to the same number of output channels as other input channels. Similarly, each output channel does not necessarily have the same number of input channels assigned to it as other output channels. A variety of possible ways of assigning a plurality of input channels to a plurality of output channels is contemplated.

With continuing reference to FIG. 1, at block 20 a routing module routes each of the input channels to the corresponding output channel or channels. As is shown by the line connecting block 18 and block 20, the routing module receives from the output configuration module the list of assignments designating how each input channel should be routed. The routing module also reads the inputs channels themselves from the memory area of the computing device, as shown by the line connecting block 14 and block 18. The routing module then routes each of the input channels to the corresponding assigned output channels, and adjusts the relative volume of each assigned output channel based on its audio scaling level.

At block 22, the routing module sends each assigned output channel to the signal-output module. The signal-output module then transmits audio signals corresponding to each of the assigned output channels to the audio interface device. From there, the audio interface device distributes the audio signals corresponding to each assigned output channel to the appropriate external speaker device.

Figure 2:
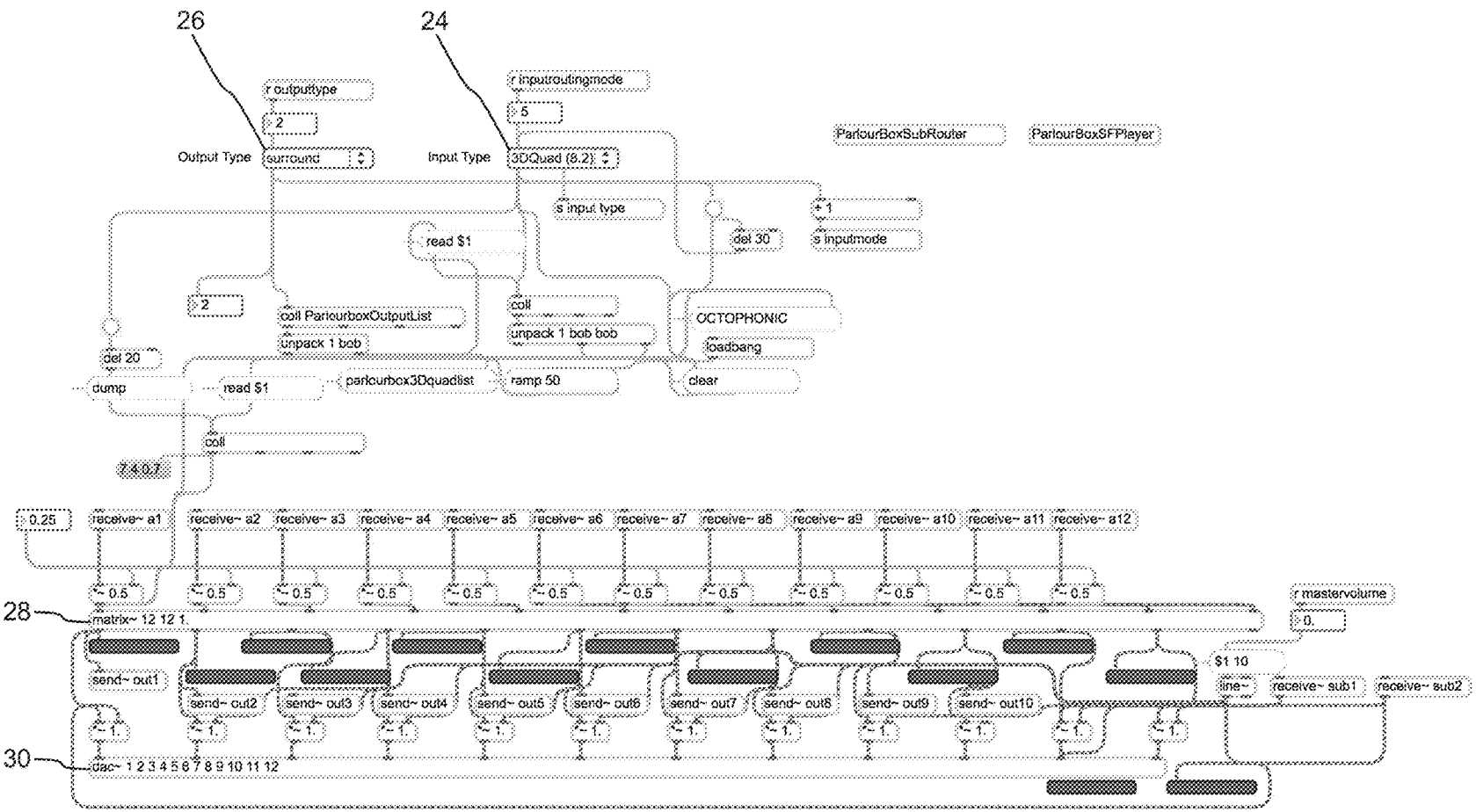
FIG. 2 is a detailed flowchart illustrating processor-executable program modules of a representative dedicated software application according to the principles herein.

In FIG. 2 is shown a detailed illustration of the processor-executable program modules as described above. As is shown by the "Input Type" drop down box 24, the input configuration module identifies the number and configuration of input channels in a multichannel audio file. The input configuration module is configured to read header information from the multichannel audio file to identify the input channels. The "Output Type" drop down box 26 shows the output configuration module identifying a desired output configuration with a number of output channels. The output configuration module identifies the desired output configuration from a list of possible output configurations based on the input configuration.

The output configuration module then assigns each of the input channels to one or more output channels based on the input and output configuration. This list of assignments is sent to the routing module.

The routing module is shown as the "matrix~" object 28. The routing module routes each input channel to one or more output channels according to the list of assignments sent by the output configuration module. Here, for example, eight input channels are shown to be connected to the routing module. The eight input channels are modeled by eight "cycle~" objects. The routing module routes each of the input channels to produce the output channels. Here, the "matrix~" object 28 is shown as outputting eight output channels. Finally, the signal-output module is shown in FIG. 2 as the "dac~" object 30. The signal-output module takes the output channels produced by the routing module and transmits them to the audio interface device.

Figure 3:
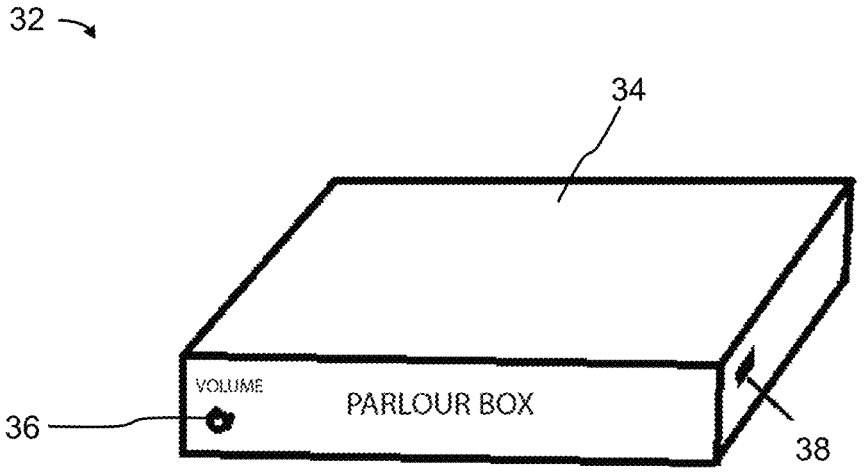
FIG. 3 is a front perspective-view illustration of an exemplary audio interface device in accordance with aspects of the present disclosure.

Referring now to FIG. 3, an exemplary audio interface device 32 is shown in accordance with aspects of the disclosed concepts. The audio interface device 32 has a housing 34 for stowing therein and generally protecting electronic hardware for receiving the assigned output channels, attenuating and decoding the received signals, and transmitting the decoded signals to the various speakers of an external speaker system, as will be described in further detail hereinbelow with respect to FIG. 6. The device 32 generally includes a volume selection input 36 and a communication interface 38, both of which are coupled to the housing 34. The volume selection input 36 is used to adjust the overall volume level of the audio played by the external speaker devices. The communication interface 38 communicatively couples to a computing device and allows the computing device to communicate with the audio interface device 32. Through the communication interface 38, the audio interface device 32 receives data from the computing device, including the audio that is to be played through the external speaker devices.

Figure 4:
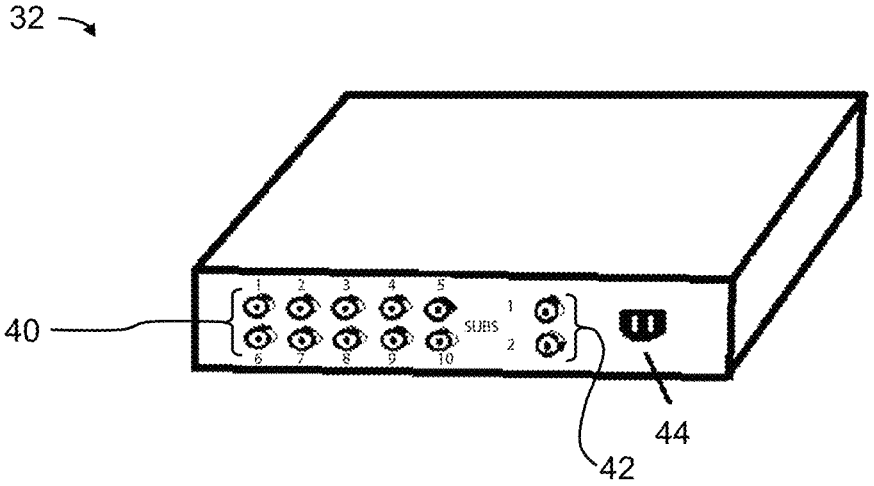
FIG. 4 is a rear perspective-view illustration of the exemplary audio interface device of FIG. 3.

FIG. 4 shows another view of an exemplary audio interface device 32. As discussed herein, the audio interface device 32 distributes audio signals to one or more external speaker devices. As seen here, the audio interface device 32 contains multiple program channel ports 40 and subwoofer ports 42 coupled to the housing 34. The program channel ports 40 are configured to output low-, mid-, or high-frequency audio signals, or any combination of the three. The subwoofer ports 42 are configured to output low-frequency audio signals. These audio signals are transmitted to one or more external speaker devices through a wired connection. In the illustrated example, the signals that are transmitted from the program channel ports 40 and the subwoofer ports 42 are line-level signals. Line-level signals are used because the external speaker devices are, for at least some embodiments, preferably self-powered. As a result, an amplified signal such as a speaker-level signal is not needed.

The audio interface device 32 also includes at least one wireless transmitter interface (not visible in the views provided) coupled to the housing 34. The wireless transmitter interface is configured to communicatively couple to one or more external speaker devices so that the audio interface device 32 can distribute audio signals to the external speaker devices through a wireless connection. The wireless transmitter interface may include a single transmission element (e.g. an antenna) used to transmit audio signals for each external speaker device. The wireless transmitter interface may alternatively include multiple transmission elements, each transmission element transmitting audio signals to one or more external speaker devices.

Generally, the audio signals transmitted to the external speaker devices will all utilize a wired connection or all utilize a wireless connection. However, it is contemplated that the audio interface device 32 may transmit audio signals corresponding to some of the assigned output channels using a wired connection and audio signals corresponding to the remaining assigned output channels using a wireless connection. The audio interface device 32 also includes a power connection 44 for powering the internal circuitry of the audio interface device 32.

The program channel ports 40 and the subwoofer ports 42 may utilize any suitable external physical connector. Non-limiting examples of such external connectors include, but are not limited to, RCA connectors, tip-ring-sleeve (TRS) connectors, tip-sleeve (TS) connectors, or any other appropriate connector that is capable of carrying line-level signals. Similarly, the wireless transmitter interface may utilize any appropriate wireless connection method. Non-limiting examples of such wireless connections include, but are not limited to, Wi-Fi, Bluetooth®, Wi-Max, IEEE 802.11 technology, and radio frequency (RF) communication.

Figure 5A:
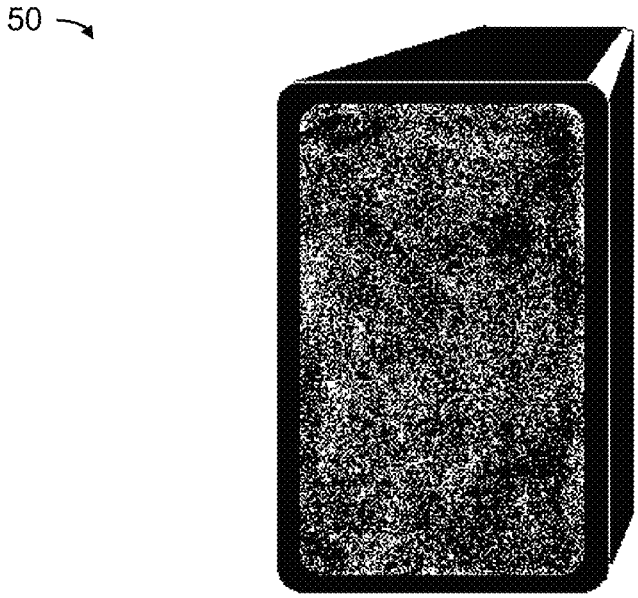
FIGS. 5A and 5B are front and rear perspective-view illustrations, respectively, of an exemplary external speaker device in accordance with aspects of the present disclosure.
Figure 5B:
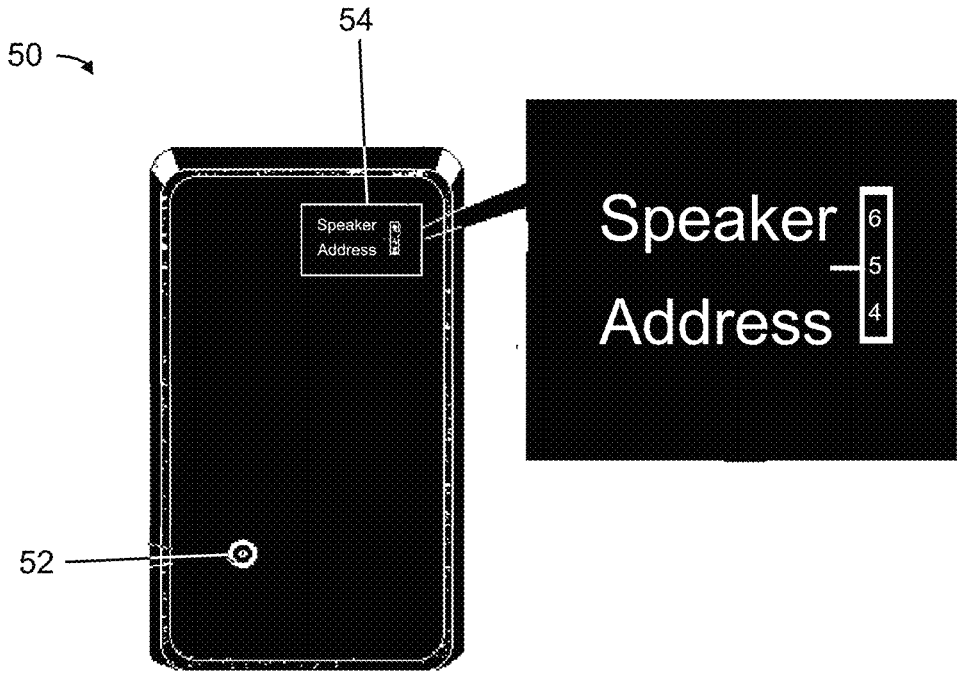

Referring now to FIGS. 5A and 5B, front and rear views of an exemplary external speaker device 50 for use with the current system is shown. The external speaker device 50 generally includes an input port 52 and an address selector 54. The input port 52 is configured to receive audio signals transmitted by the program channel ports 40 and the subwoofer ports 42 of the audio interface device 32. The input port 52 may utilize a variety of connectors, such as, but not limited to RCA connectors, TRS connectors, or TS connectors. The type of input port 52 on the external speaker device 50 will generally correspond to the type of port on the audio interface device 32. For example, if the program channel ports 40 and the subwoofer ports 42 on the audio interface device 32 utilize RCA connectors, the input port 52 will also utilize an RCA connector.

The external speaker device 50 also includes a wireless receiver interface (not visible in the views provided) that is configured to receive audio signals transmitted by the wireless transmitter interface of the audio interface device 32. The wireless receiver interface generally utilizes the same wireless connection method as the wireless transmitter interface. The existence of both an input port 52 and a wireless receiver interface on the external speaker device 50 allows the system to be used in a variety of conditions. For example, in a user's residence where there is preferably a strong Wi-Fi connection, a wireless connection between the audio interface device 32 and the external speaker devices 50 would be utilized. However, if a wireless connection would be very weak or is impossible, a wired connection between the audio interface device 32 and the external speaker devices 50 could alternatively be utilized.

The external speaker device 50 also includes an address selector 54. The address selector 54 is used to designate each individual external speaker device 50 with an address and enables the wireless transmitter interface to transmit specific audio signals to each external speaker device 50. Generally the address selector 54 is used when the external speaker device 50 is connected to the audio interface device 32 using a wireless connection. For example, setting a specific speaker's address selector 54 to "1" will result in the audio interface device 32 transmitting audio signals corresponding to the first output channel to that specific external speaker device. Generally, the system is able to transmit signals to twelve external speaker devices at any time. In that case, the address selector 54 may include an address designation of one through twelve. However, it is contemplated that more than twelve external speaker devices 50 may be connected to the audio interface device 32 at any given time, in which case the address selector 54 would include more than twelve possible addresses. The address selector 54 does not need to be utilized when the external speaker device 50 is connected to the audio interface device 32 using a wired connection.

Figure 6:
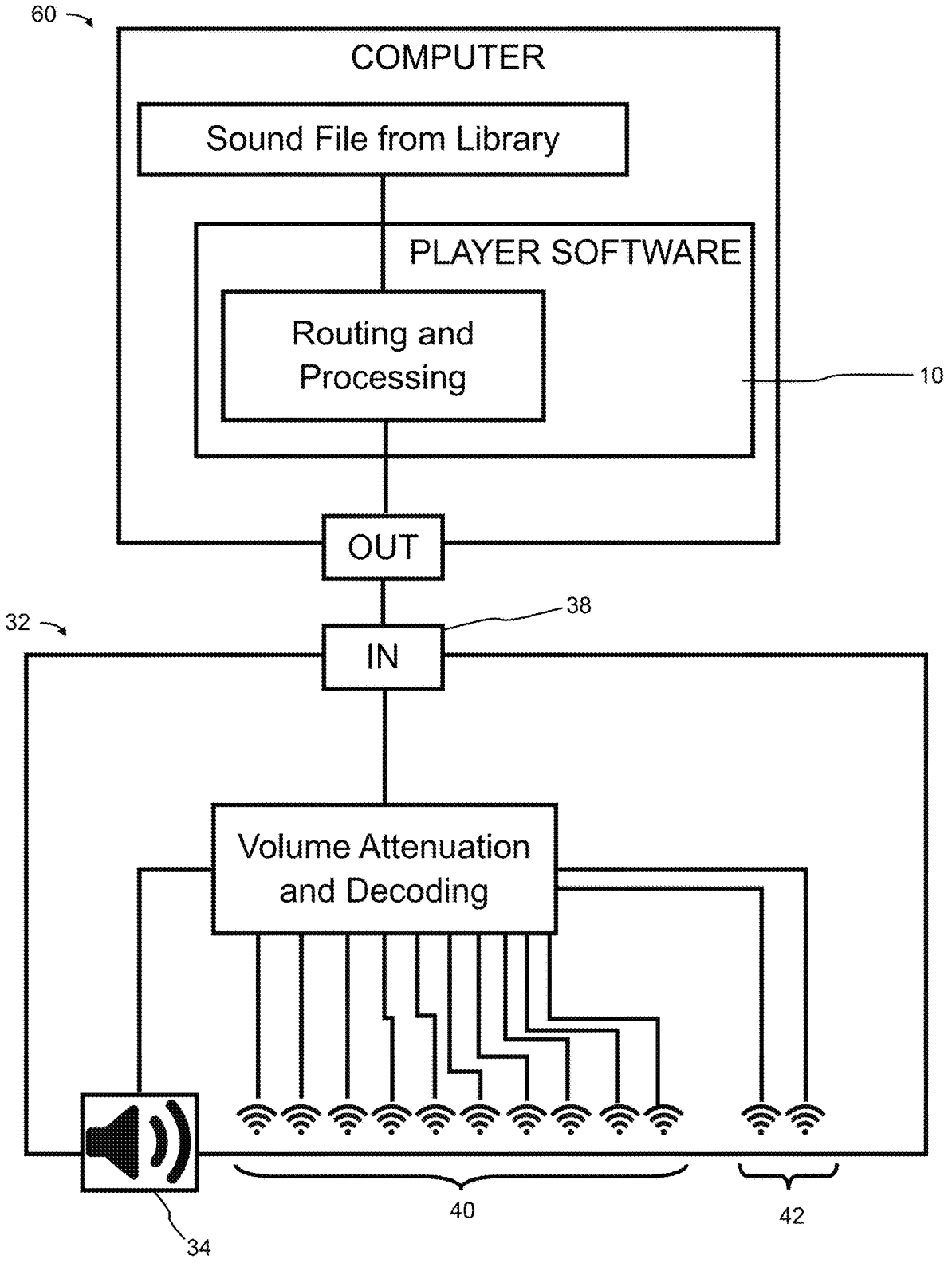
FIG. 6 is a schematic diagram illustrating an example system in accordance with aspects of the present disclosure.

In FIG. 6 is shown a general internal schematic of an audio interface device 32 and a computing device 60. As is shown, the audio interface device 32 is communicatively coupled to the computing device 60 through the communication interface 38. The computing device 60 utilizes a dedicated software application 10 containing a number of processor-executable program modules to perform the methods as described herein. Audio signals corresponding to the assigned output channels are transmitted by the computing device 60 to the audio interface device 32 through the communications interface 38. The audio interface device 32 then distributes the audio signals to the appropriate external speaker devices. FIG. 6 shows the audio interface device 32 utilizing the wireless transmitter interface to distribute the audio signals. As shown, the wireless transmitter interface may comprise multiple individual transmission elements (e.g. antennas) labeled here as 1-10 and "sub." The transmission elements 1-10 are generally used to transmit audio signals corresponding to the program channels. The "sub" transmission elements are used to transmit audio signals corresponding to the subwoofer channels. Generally, each individual transmission element transmits audio signals to a single external speaker device. However, an individual transmission element may transmit audio signals to multiple external speaker devices. Alternatively, the wireless transmitter interface may alternatively consist of a single transmission element that is used to distribute audio signals to all of the external speaker devices. Moreover, as described herein, the audio interface device 32 also includes one or more program channel ports 40 and subwoofer ports 42 that are able to transmit audio signals to the external speaker devices using a wired connection. The audio interface device 32 generally includes a decoder that may be used to distribute audio signals to the wireless transmitter interface, the program channel ports 40, and the subwoofer ports 42.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What is claimed:

1. A multichannel audio system for reconfiguring and routing multichannel audio files to one or more speaker devices, the multichannel audio system comprising:

an audio interface device comprising:

a plurality of line-level program channel ports each configured to output an audio signal to a speaker; and a computing device in communication with the audio interface device, wherein the computing device is configured to:

identify a plurality of input channels in a multichannel audio file, wherein each input channel includes an audio signal including a frequency bandwidth, assign each of the input channels to two or more output channels, route the entire frequency bandwidth of each of the input channels to each of the assigned two or more output channels, and transmit an audio output signal including the entire frequency bandwidth corresponding to each output channel to the audio interface device, wherein the computing device is configured to identify at least:

a first multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, and a second multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the second multichannel audio file is different than the first multichannel audio file.

2. The multichannel audio system of claim 1, wherein the computing device is configured to assign at least one input channel to two or more output channels.

3. The multichannel audio system of claim 1, wherein the computing device is configured to assign each of the input channels to two or more output channels.

4. The multichannel audio system of claim 1, wherein the computing device is configured to identify a plurality of input channels associated with each of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file.

5. The multichannel audio system of claim 1, wherein the computing device further comprises:

an output configuration module including a list of assignments designating how each input channel should be routed, and a routing module configured to route, according to the output configuration module, each of the plurality of input channels to output channels associated with each of: a two channel output configuration, a four channel output configuration, a five channel output configuration, an eight channel octophonic output configuration, an eight channel dual quadrophonic output configuration, an eight channel 3D quadrophonic output configuration, a ten channel decaphonic output configuration, a ten channel dual surround output configuration, and a ten channel 3D surround configuration.

6. The multichannel audio system of claim 1, wherein the computing device is configured to identify at least a third multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the third multichannel audio file is different from the first multichannel audio file and the second multichannel audio file.

7. The multichannel audio system of claim 6, wherein the computing device is configured to identify at least a fourth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the fourth multichannel audio file is different from the first multichannel audio file, the second multichannel audio file, and the third multichannel audio file.

8. The multichannel audio system of claim 7, wherein the computing device is configured to identify at least a fifth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the fifth multichannel audio file is different from the first multichannel audio file, the second multichannel audio file, the third multichannel audio file, and the fourth multichannel audio file.

9. The multichannel audio system of claim 8, wherein the computing device is configured to identify at least a sixth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the sixth multichannel audio file is different from the first multichannel audio file, the second multichannel audio file, the third multichannel audio file, the fourth multichannel audio file, and the fifth multichannel audio file.

10. The multichannel audio system of claim 9, wherein the computing device is configured to identify at least a seventh multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the seventh multichannel audio file is different from the first multichannel audio file, the second multichannel audio file, the third multichannel audio file, the fourth multichannel audio file, the fifth multichannel audio file, and the sixth multichannel audio file.

11. The multichannel audio system of claim 10, wherein the computing device is configured to identify at least an eighth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the eighth in multichannel audio file is different from the first multichannel audio file, the second multichannel audio file, the third multichannel audio file, the fourth multichannel audio file, the fifth multichannel audio file, the sixth multichannel audio file, and the seventh multichannel audio file.

12. The multichannel audio system of claim 1, wherein a number of the plurality of input channels in the multichannel audio file is different than a number of the plurality of output channels.

13. A method of playing a multichannel audio file on an audio system, the method comprising:

selecting a multichannel audio file to be played;

identifying, via a computing device, a plurality of input channels associated with the multichannel audio file, wherein each input channel includes an audio signal including a frequency bandwidth;

identifying an output configuration corresponding to an audio system, wherein the output configuration includes a plurality of output channels;

assigning each of the input channels to two or more of the output channels;

assigning an audio scaling level to each of the input channel-output channel assignments; and causing the entire frequency bandwidth of each input channel of the multichannel audio file to be played through each of the respective assigned two or more output channels of the audio system, wherein the computing device is configured to identify at least:

a first multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, and a second multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the second multichannel audio file is different than the first multichannel audio file.

14. The method of claim 13, wherein the step of assigning the audio scaling levels comprises assigning each of the input channels to two or more output channels.

15. The method of claim 13, wherein the step of identifying the plurality of input channels comprises identifying whether the multichannel audio file is any one of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file.

16. The method of claim 13, wherein the step of assigning each of the input channels comprises assigning each of the plurality of input channels to output channels associated with any one of: a two channel output configuration, a four channel output configuration, a five channel output configuration, an eight channel octophonic output configuration, an eight channel dual quadrophonic output configuration, an eight channel 3D quadrophonic output configuration, a ten channel decaphonic output configuration, a ten channel dual surround output configuration, and a ten channel 3D surround configuration.

17. The method of claim 13, wherein the computing device is configured to identify at least a third multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the third multichannel audio file is different from the first multichannel audio file and the second multichannel audio file.

18. The method of claim 17, wherein the computing device is configured to identify at least a fourth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the fourth multichannel audio file is different from the first multichannel audio file, the second multichannel audio file, and the third multichannel audio file.

19. The method of claim 18, wherein the computing device is configured to identify at least a fifth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the fifth multichannel audio file is different from the first multichannel audio file, the second multichannel audio file, the third multichannel audio file, and the fourth multichannel audio file.

20. The method of claim 19, wherein the computing device is configured to identify at least a sixth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the sixth multichannel audio file is different from the first multichannel audio file, the second multichannel audio file, the third multichannel audio file, the fourth multichannel audio file, and the fifth multichannel audio file.

21. The method of claim 20, wherein the computing device is configured to identify at least a seventh multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the seventh multichannel audio file is different from the first multichannel audio file, the second multichannel audio file, the third multichannel audio file, the fourth multichannel audio file, the fifth multichannel audio file, and the sixth multichannel audio file.

22. The method of claim 21, wherein the computing device is configured to identify at least an eighth multichannel audio file selected from the group consisting of: a two channel audio file, a four channel audio file, a five channel audio file, an eight channel octophonic audio file, an eight channel dual quadrophonic audio file, an eight channel 3D quadrophonic audio file, a ten channel decaphonic audio file, a ten channel dual surround audio file, and a ten channel 3D surround audio file, wherein the eighth multichannel audio file is different from the first multichannel audio file, the second multichannel audio file, the third multichannel audio file, the fourth multichannel audio file, the fifth multichannel audio file, the sixth multichannel audio file, and the seventh multichannel audio file.

23. The method of claim 13, wherein a number of the plurality of input channels in the multichannel audio file is different than a number of the plurality of output channels.

* * * * *